US005926867A

United States Patent [19]

Buchanan

[11] Patent Number: 5,926,867

[45] Date of Patent: Jul. 27, 1999

[54] ILLUMINATED TOILET TARGET DEVICE

[76] Inventor: Craig Buchanan, 101 Century Dr., Suite 104, Jacksonville, Fla. 32216

[21] Appl. No.: 08/976,109

[22] Filed: Nov. 21, 1997

[51] Int. Cl.[6] ..... A47K 17/00; F21V 33/00

[52] U.S. Cl. ..... 4/661; 353/43; 353/46; 353/62; 362/101

[58] Field of Search ..... 4/661; 362/101, 362/200, 576, 259, 276; 353/11, 28, 43, 62, 46

[56] References Cited

U.S. PATENT DOCUMENTS

| | | | |
|---|---|---|---|
| 4,491,991 | 1/1985 | Herbruck | 4/661 |
| 4,736,471 | 4/1988 | Johnson | 4/661 |
| 4,779,176 | 10/1988 | Bornhorst | 353/62 |
| 5,253,000 | 10/1993 | Stoeckner | 353/46 |
| 5,276,595 | 1/1994 | Patrie | 4/661 |
| 5,450,148 | 9/1995 | Shu et al. | 353/43 |
| 5,526,076 | 6/1996 | Walker | 353/43 |
| 5,664,867 | 9/1997 | Martin et al. | 4/661 |

*Primary Examiner*—Henry J. Recla
*Assistant Examiner*—Tuan Nguyen
*Attorney, Agent, or Firm*—Thomas C. Saitta

[57] ABSTRACT

A device for producing a moving target on the surface of the water in a toilet bowl. The target is an illuminated pattern, words or design visible in all light conditions and emanating form a housing mounted onto the toilet itself or a wall or ceiling above the toilet. The target may change position continuously or discontinuously.

14 Claims, 3 Drawing Sheets

ILLUMINATED TOILET TARGET DEVICE

BACKGROUND OF THE INVENTION

The invention relates generally to the field of illumination devices used in connection with toilets, and more particularly to such devices which provide a target within the water bowl area for training or amusement of male users. Even more particularly, the invention relates to such devices providing a moving target.

It is known to provide illuminating devices for toilets, the primary purpose of the device being to provide a low level of visible light which is sufficient to illuminate the bowl at night when the house lights are turned off. This illumination directs the user to the toilet and in some cases provides an indication of the position of the toilet seat. Examples of such devices are seen in U.S. Pat. No. 3,982,288 to Borne, showing an internally illuminated seat, U.S. Pat. Nos. 4,413,364 to Bittaker et al., 5,003,648 to Anderson, and 5,150,962 to Rauschenberger, each showing bulbs mounted in the toilet bowl or around the rim, and U.S. Pat. No. 5,276,595 to Patrie showing a light mounted to the underside of the toilet seat cover. Activation and deactivation by switches, motion detectors, timers, etc. are taught in various of these patents.

Target devices are also known, where an aiming "target" is provided within the toilet bowl. These targets are provided either for the amusement of male users or for training purposes for young boys—the provision of a target creating an incentive to use the toilet while standing and also acting as a teaching means to improve aim. Examples of such devices are seen in U.S. U.S. Pat. No. 2,703,407 to Henoch et al., which shows a mechanical target comprising a rotatable paddle-like member attached to an arm mounted onto the side of the toilet, whereby the target is positioned in the center of the bowl above the water, in U.S. Pat. No. 4,044,405 to Kreiss, which shows a non-removable bulls-eye target adhesively affixed to the bottom of the toilet bowl, and in U.S. Pat. No. 5,117,515 to White, Jr., which shows floating, flushable targets printed onto paper stock which are placed onto the surface of the water within the bowl. A consumer product advertised in a recent catalog shows a device similar to the Patrie device, since it is mounted on the toilet seat cover, but the device has a light covered by a mask which creates a bulls-eye target on the surface of the water. The mechanical target suffers from the drawback of having to be cleaned frequently, since the object is to strike it with a stream of urine, and the rapid rotation of the paddle will centrifugally sling urine in multiple directions. The affixed bulls-eye target must also be cleaned since it permanently resides in the bottom of the bowl, and its stationary nature results in the novelty becoming commonplace and uninteresting after several events. Likewise, the illuminated bulls-eye target also becomes boring since it too is stationary. The floating targets have the advantage of movement once the user begins to urinate, therefore providing an element of challenge or entertainment, but the target must be replaced after every flushing.

It is an object of this invention to provide a moving illuminated target projected onto the surface of the water to overcome the drawbacks of the above referenced prior art devices. The illuminated target eliminates the need to clean the target or replace a target after every flush. Controlled or random movement of the target insures that the novelty, challenge, training and entertainment value of the device will last.

SUMMARY OF THE INVENTION

The invention comprises in general an illuminated toilet target device, the device projecting a moving target onto the surface of the water in the toilet bowl. The device is mounted onto the toilet itself, preferably on the underside of the seat cover or onto the front of the toilet tank, or onto the wall or ceiling of the bathroom. The target may be a simple dot, a pattern, such as a bulls-eye or the like, a logo or design, a word or words, etc. The device is designed such that the target is not stationary, but instead changes position in the bowl in a continuous or non-continuous manner. The target may be produced by a standard light bulb with the light passed through moving or alternating apertures which open and close, through moving masks or lenses, through optical fibers which move or alternate in sequence, onto moving or vibrating mirrors, or the bulb housing may itself move. The target may also be produced by a small laser, with the target moved by moving the laser itself or by passage of the beam through various media as previously mentioned. Preferably the device is self-powered by a battery, but it could also be externally powered. The device may be activated by a dedicated switch, a switch mounted on the toilet seat or cover, or by a motion detector or other sensing device.

DETAILED DESCRIPTION OF THE INVENTION

With reference to the drawings, the invention will now be described in detail with regard for the best mode and preferred embodiment. In general, the invention is a device which creates a visible moving pattern or target on the surface of the water in a toilet bowl and is designed to provide entertainment to males while urinating into the toilet or to encourage toilet usage by young males learning to urinate while standing up. In the figures, the dashed line arrows for the target indicate different or alternate positions of the target shown as the solid line arrow.

Figure 1:
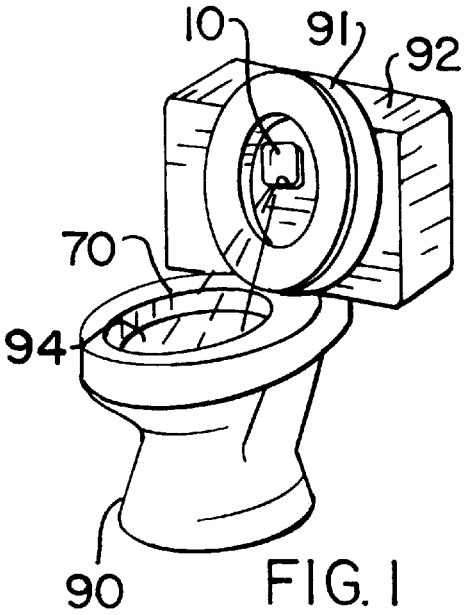
FIG. 1 is a perspective view of the device mounted on the seat cover of a toilet.
Figure 2:
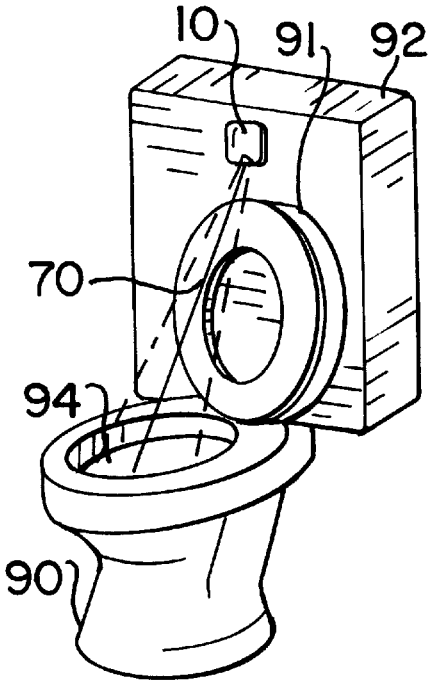
FIG. 2 is a perspective view of the device mounted on the tank of the toilet.
Figure 3:
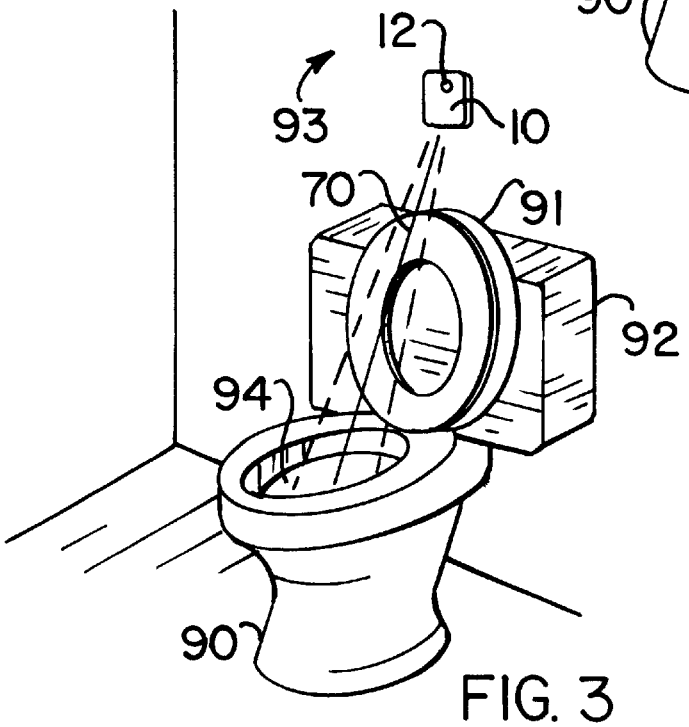
FIG. 3 is a perspective view of the device mounted on the wall of the bathroom.

A shown in FIGS. 1 through 3, the invention comprises housing means 10, consisting of a durable container for the operating components of the device, made for example of plastic or metal, which is mounted onto the toilet 90 either on the underside of the toilet seat cover 91 or the upper portion of the tank 92, if the tank extends above the seat cover 91, or onto the wall 93 or ceiling above the toilet 90. The housing 10 may be affixed by any suitable means, such as by adhesives or mechanical fasteners. Because of the environment where the device will be used, it is preferred that the housing 10 completely encase the operating components with no openings to allow passage of liquids, cleansers, etc. Housing 10 is therefore preferably provided with a target aperture 11 comprised of a transparent material such as plastic or glass. The housing 10 is positioned such that the visible moving pattern or target 70 is directed onto the surface of the water in the toilet bowl 94.

Figure 4:
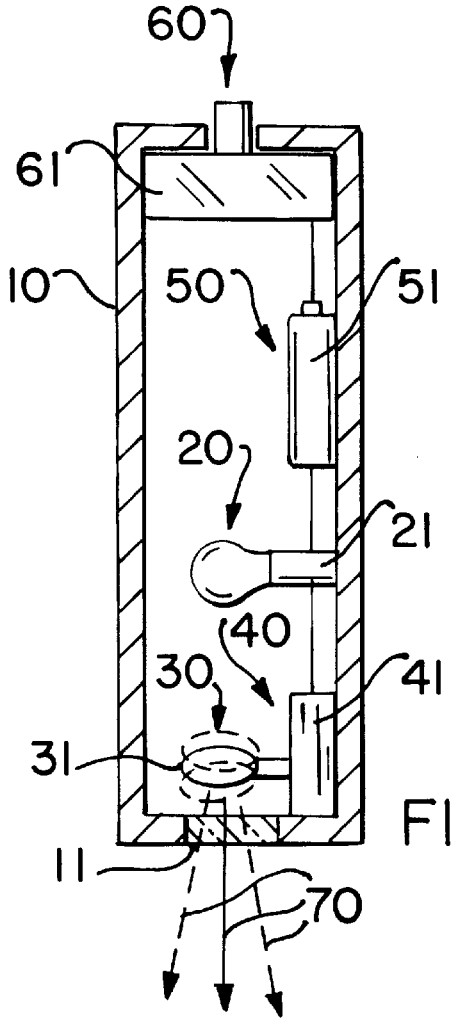
FIG. 4 is a cross-sectional view with components exposed, showing an embodiment of the device with a bulb light source and a moving lens.

The device comprises illumination means 20, target production means 30, target movement means 40, power means 50 and activation means 60, all connected in electrical communication (shown only representationally) in well known manner using wire circuitry, circuit boards, etc. A basic embodiment for the device is shown in FIG. 4, where the illumination means 20 comprises a bulb light source 21, the target production means 30 comprises a transparent lens 31 to focus the light from the bulb 21 into a defined target or target pattern 70, such as a spot, circle or other shape, the target movement means 40 comprises a mechanical motor 41 which moves or vibrates the lens 31 to alter the position of the target 70 in the toilet bowl 94, the power means 50 comprises a small battery 51, and the activation means 60 comprises a manual switch 61. When the device is activated by proper manipulation of switch 61, power from the battery 51 is delivered to the bulb 21, creating light which is transmitted through the lens 31 and target aperture 11 onto the water surface. Power is also delivered to the motor 41, which moves the lens 31 either randomly or in a predetermined pattern. This movement of the lens 31 causes the position of the target pattern 70 to move about on the water surface, providing a challenge or game to the user, who attempts to continuously strike the target 70. Alternatively, the motor 41 could alter the position of the target pattern 70 by moving the illumination means 20 while the lens 31 remains stationary.

Figure 5:
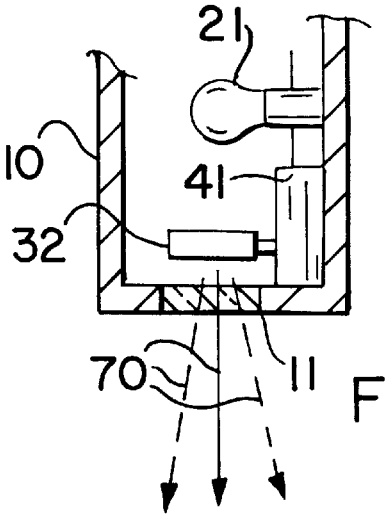
FIG. 5 is a partial cross-sectional view of an embodiment of the device showing a moving apertured mask.

FIG. 5 shows a variation for the device, where the target production means 30 comprises an apertured mask 32. The design of the mask 32 determines the target pattern 70, and an infinite number of designs can be provided—ranging from simple bulls-eye patterns to words or names to figures or faces. The mask 32 is connected to the mechanical motor 41, again such that the motor 41 moves the mask 32, or the motor 41 is connected to the illumination means 20 so that the illumination means 20 is moved relative to the mask 32, thereby moving the target 70 about the water surface.

Figure 6:
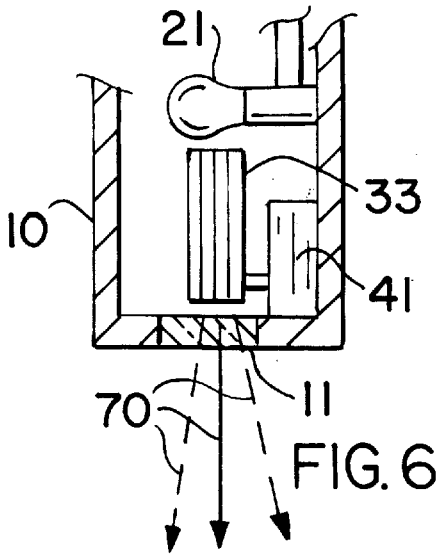
FIG. 6 is a partial cross-sectional view of an embodiment of the device showing a moving bundle of optical fibers.

Another variation of the device is shown in FIG. 6, where a bundle of optical fibers 33 comprise the target production means 30. The optical fibers 33 are moved by the motor 41 to move the target 70 about. Alternatively, the optical fibers 33 could be left stationary and illumination means 20 moved, or a blocking mask (not shown) moved by the target movement means 40 could be positioned between the illumination means 20 and the optical fibers 33, whereby only one or a few of the fibers 33 would have light passing through at any given time. In this embodiment the target 70 would appear to change position discontinuously, popping on and off at different spots on the water surface, as the fibers 33 would each be directed at a different location.

Figure 7:
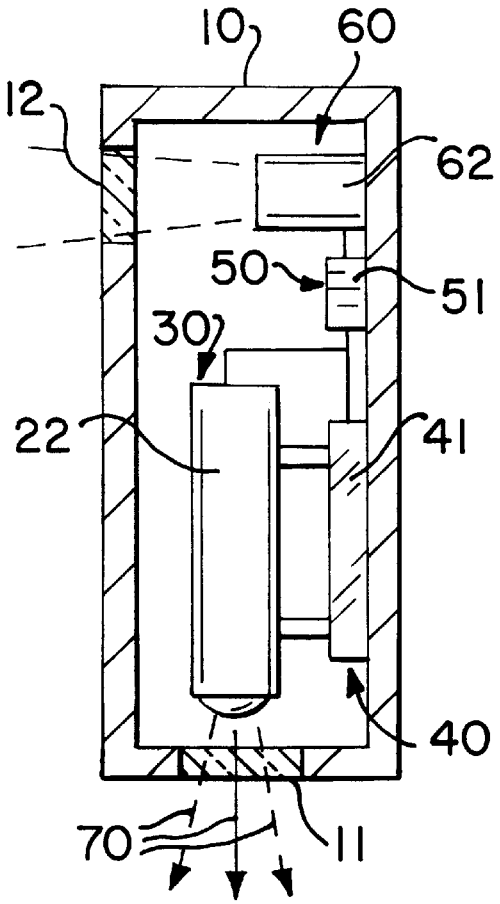
FIG. 7 is a cross-sectional view of an embodiment of the device showing a moving laser light source and a sensor activation device.

FIG. 7 shows another embodiment of the device, wherein the illumination source 20 is a small laser 22 which produces a spot target 70. The target 70 is moved by physically moving or vibrating the laser 22 by connection to motor 41. This figure also shows a preferred alternative activation means 60, here comprising a sensor of a type commonly known in the industry, such as an infrared detector, to detect the presence of a person at the toilet 90. With this type of activation means 60, the device automatically turns on when a person is present, but shuts off to conserve battery power after the person has left. For this construction, the housing 10 is provided with a sensor aperture 12, preferably formed of a glass or transparent plastic material. It is also contemplated that power means 50 could be conductive wiring means to connect directly to the building's electrical system, not shown.

Figure 8:
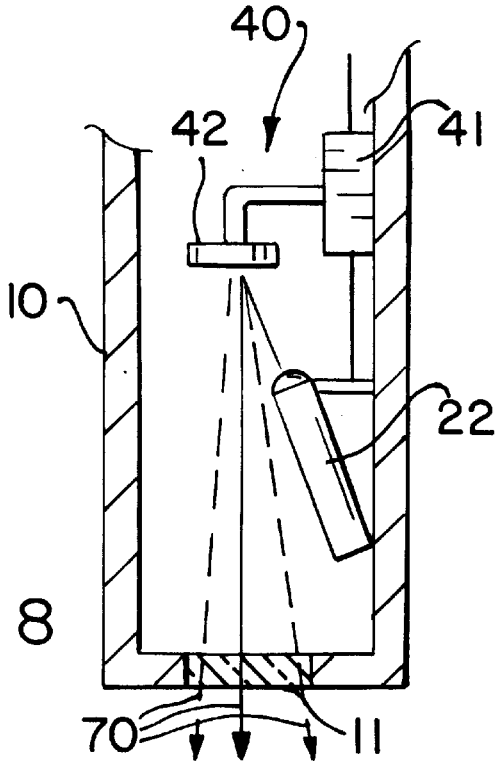
FIG. 8 is a partial cross-sectional view of an embodiment of the device showing a moving mirror.

Still another embodiment for the device is shown in FIG. 8, where the target movement means 40 comprises a moving mirror 42 connected to motor 41. A beam from a laser 22 is bounced off the moving mirror 42 to produce the moving target 70 on the water surface. In like manner, a pair of mirrors 42 could be arranged, with one mirror 42 controlled by target movement means 40 in the x-axis and the other mirror 42 controlled in the y-axis, in well known manner to produce precise movement of the target 70.

It is contemplated that certain equivalents and substitutions for components and elements set out above may be obvious to those skilled in the art. The true scope and definition of the invention therefore is to be as set forth in the following claims.

I claim:

1. A moving illuminated toilet target device comprising:

(A) illumination means comprising a light source capable of producing a beam of light visible on the surface of water in a toilet bowl, (B) target production means to shape the visible light beam into a defined target pattern appearing on said water surface, (C) target movement means to cause the position of said defined target pattern to move relative to said water surface, where said defined target pattern does not change shape during movement, (D) power means in electrical communication with said illumination means and said target movement means to provide power to said illumination means and said target movement means, (E) housing means containing said illumination means, said target production means and said target movement means, said housing means remaining stationary during movement of said defined target pattern, and (F) activation means to deliver power to said illumination means and said target movement means, said activation means comprising a sensor for detecting the presence of a user.

2. The device of claim 1, where said illumination means comprises a bulb light source.

3. The device of claim 1, where said illumination means comprises a laser light source.

4. The device of claim 1, where said target production means comprises a mask.

5. The device of claim 1, where said target production means comprises a lens.

6. The device of claim 1, where said target production means comprises a bundle of optical fibers.

7. The device of claim 1, where said target movement means comprises a motor.

8. The device of claim 7, where said target movement means further comprises a mirror.

9. The device of claim 1, where said power means comprises a battery.

10. The device of claim 1, further comprising activation means to deliver power to said illumination means and said target movement means.

11. The device of claim 10, where said activation means comprises a switch.

12. The device of claim 1, where said target movement means moves said target pattern in a discontinuous manner.

13. The device of claim 1, where said target pattern comprises a design.

14. The device of claim 1, where said target pattern comprises a word.

* * * * *